US011035141B1

(12) United States Patent
Shorten

(10) Patent No.: US 11,035,141 B1
(45) Date of Patent: Jun. 15, 2021

(54) APPARATUS AND SYSTEM FOR PROTECTING THE INTERIOR OF A STRUCTURE FROM FLOOD WATER

(71) Applicant: Flood Risk America, Inc., Lake Worth, FL (US)

(72) Inventor: David Wayne Shorten, Mays Landing, NJ (US)

( * ) Notice: Subject to any disclaimer, the term of this patent is extended or adjusted under 35 U.S.C. 154(b) by 0 days.

(21) Appl. No.: 16/583,894

(22) Filed: Sep. 26, 2019

Related U.S. Application Data

(60) Provisional application No. 62/859,124, filed on Jun. 9, 2019, provisional application No. 62/752,438, filed on Oct. 30, 2018.

(51) Int. Cl.
*E04H 9/14* (2006.01)
*E04C 2/16* (2006.01)
*E06B 9/00* (2006.01)

(52) U.S. Cl.
CPC ..... *E04H 9/145* (2013.01); *E04C 2/16* (2013.01); *E06B 2009/007* (2013.01)

(58) Field of Classification Search
CPC ..... E04H 9/145; E06B 9/02; E06B 2009/007; E06B 9/00; Y02A 50/00; E02B 7/02; Y10S 52/12
See application file for complete search history.

(56) References Cited

U.S. PATENT DOCUMENTS 4,272,934 A * 6/1981 Cowden ..... E06B 3/28 52/202
4,346,541 A * 8/1982 Schmitt ..... B32B 3/28 52/309.11
4,513,548 A * 4/1985 Parker ..... B60J 7/104 296/211
5,486,391 A * 1/1996 Tyner ..... B32B 5/18 428/44
6,269,597 B1 * 8/2001 Haas ..... E06B 9/02 49/464
8,869,455 B1 * 10/2014 McFall ..... E06B 9/02 49/466
9,027,293 B1 * 5/2015 Scott ..... E06B 9/02 52/202
2007/0271852 A1 * 11/2007 Vaughn ..... E06B 9/02 49/466
2008/0098679 A1 * 5/2008 Chan ..... E06B 9/02 52/302.1
2011/0173925 A1 * 7/2011 Brown ..... E04C 2/386 52/794.1
2012/0315093 A1 * 12/2012 Taylor ..... E02B 3/108 405/114
2019/0017315 A1 * 1/2019 Barresi ..... E04H 9/145

FOREIGN PATENT DOCUMENTS

DE 4404216 A1 * 8/1995 ..... E06B 9/00

* cited by examiner

*Primary Examiner* — Jessie T Fonseca
(74) *Attorney, Agent, or Firm* — Ted Masters

(57) ABSTRACT

Apparatus for protecting the interior of a structure from flood water includes a panel which is shaped and dimensioned to cover the opening in the structure. The panel is fabricated from foam which is covered by a skin. The panel is positioned over a window or other opening of the structure and removably connected to the structure. In another embodiment, multiple panels are connected together to span a wide opening. The panel(s) can be made in different shapes and sizes to accommodate different opening configurations.

15 Claims, 13 Drawing Sheets

FIG. 11
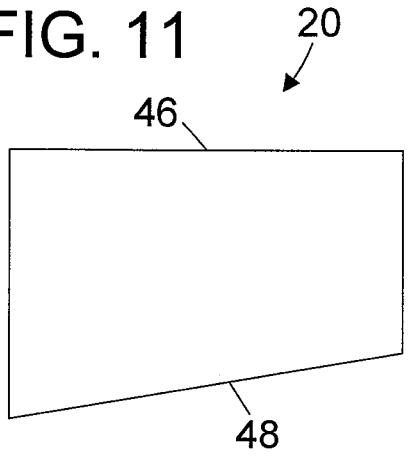
FIG. 12
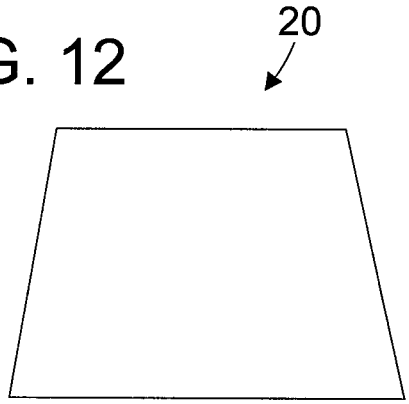
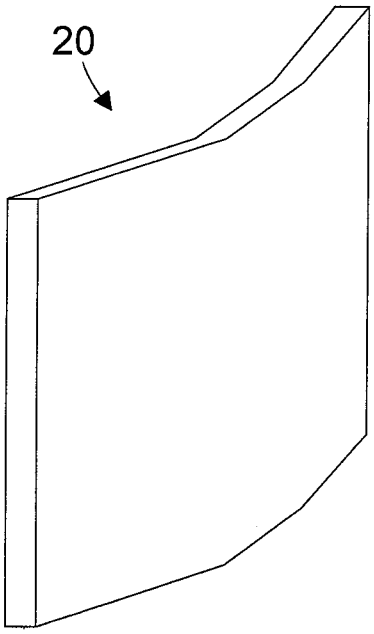
FIG. 13
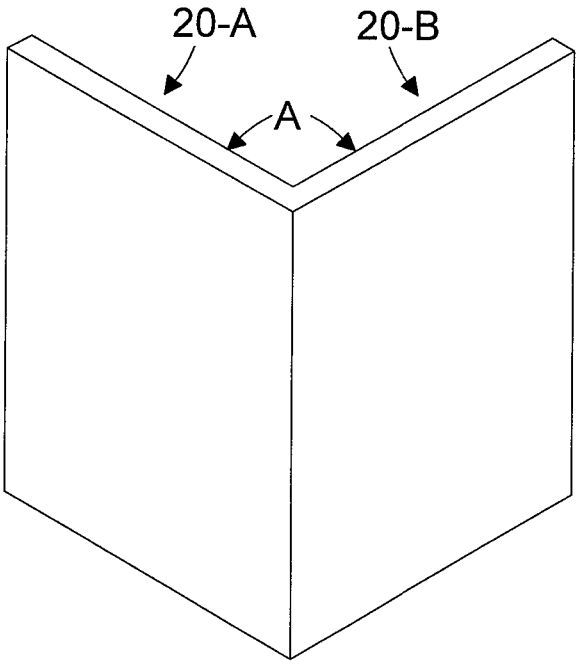
FIG. 14

FIG. 15
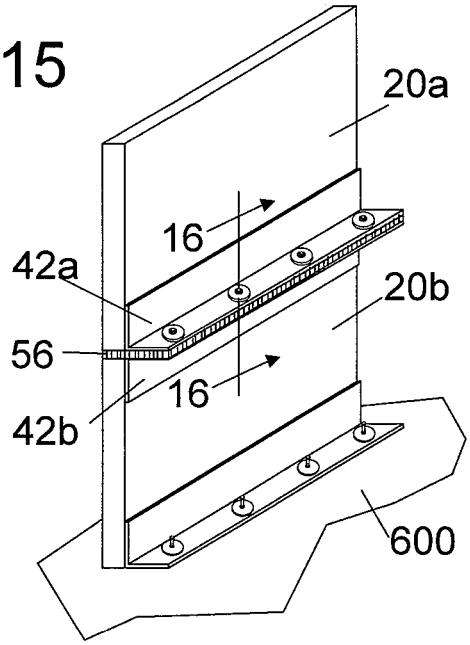
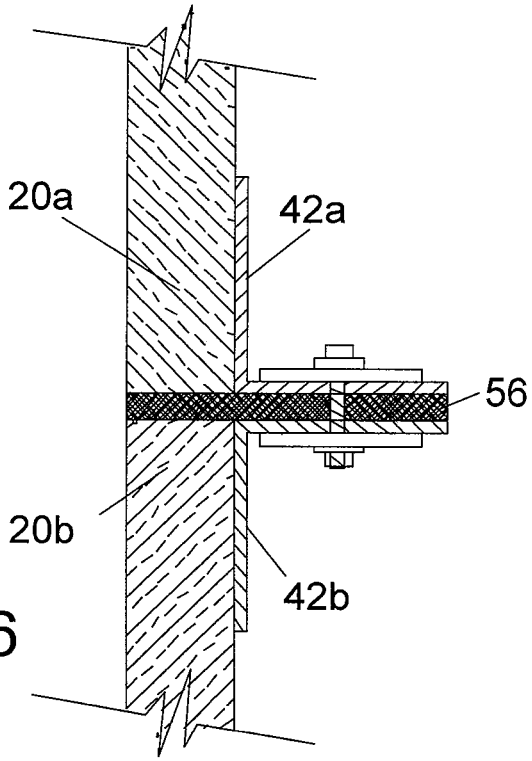
FIG. 16

FIG. 17
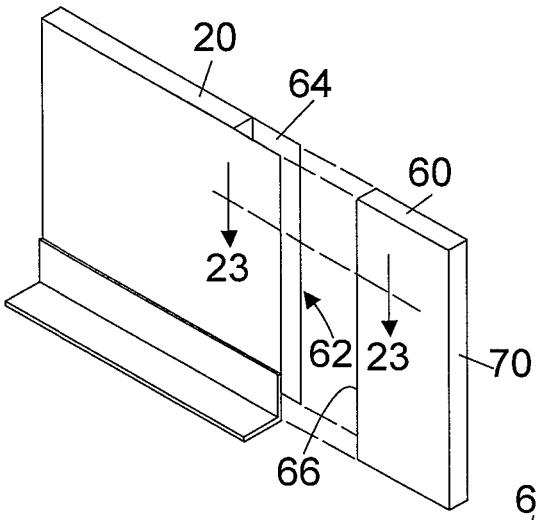
FIG. 18
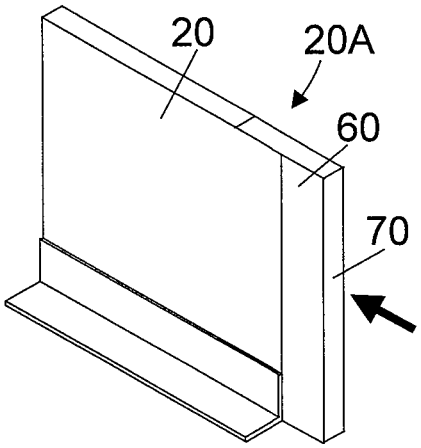
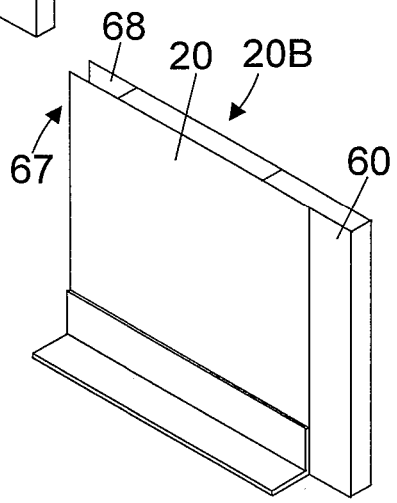
FIG. 19
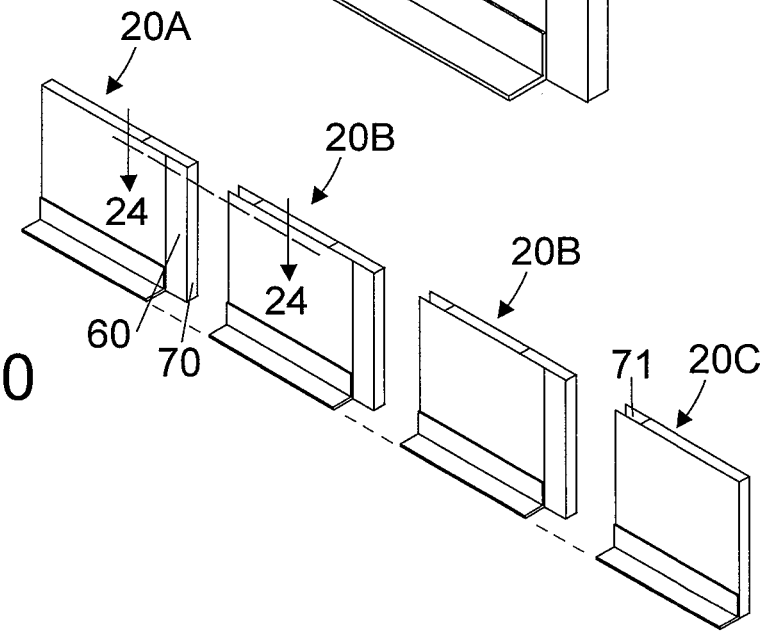
FIG. 20

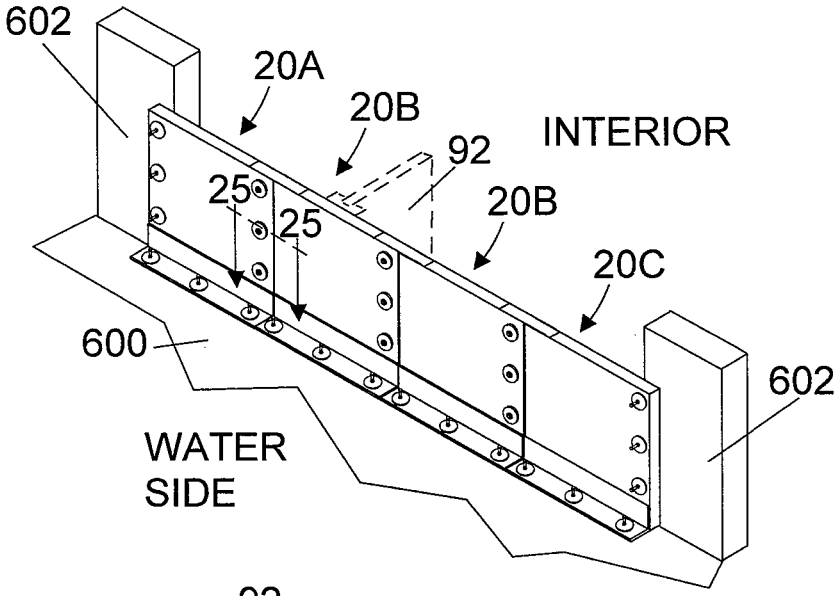
FIG. 21
FIG. 22
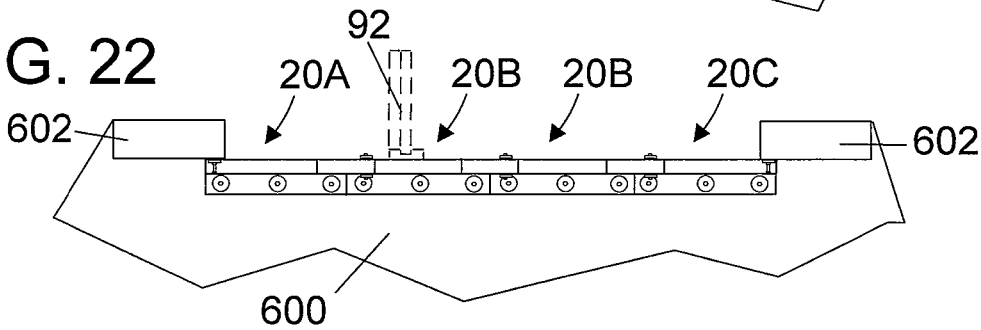
FIG. 23
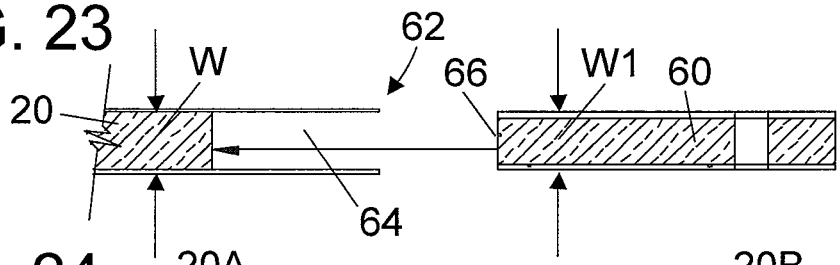
FIG. 24
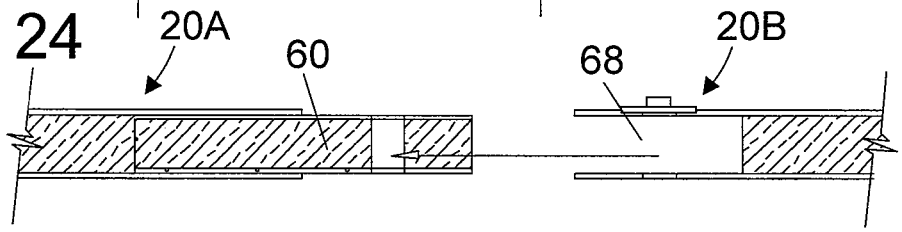
FIG. 25
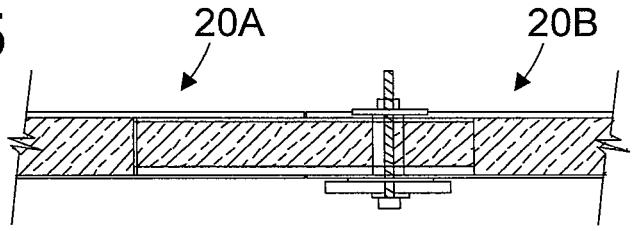

FIG. 30
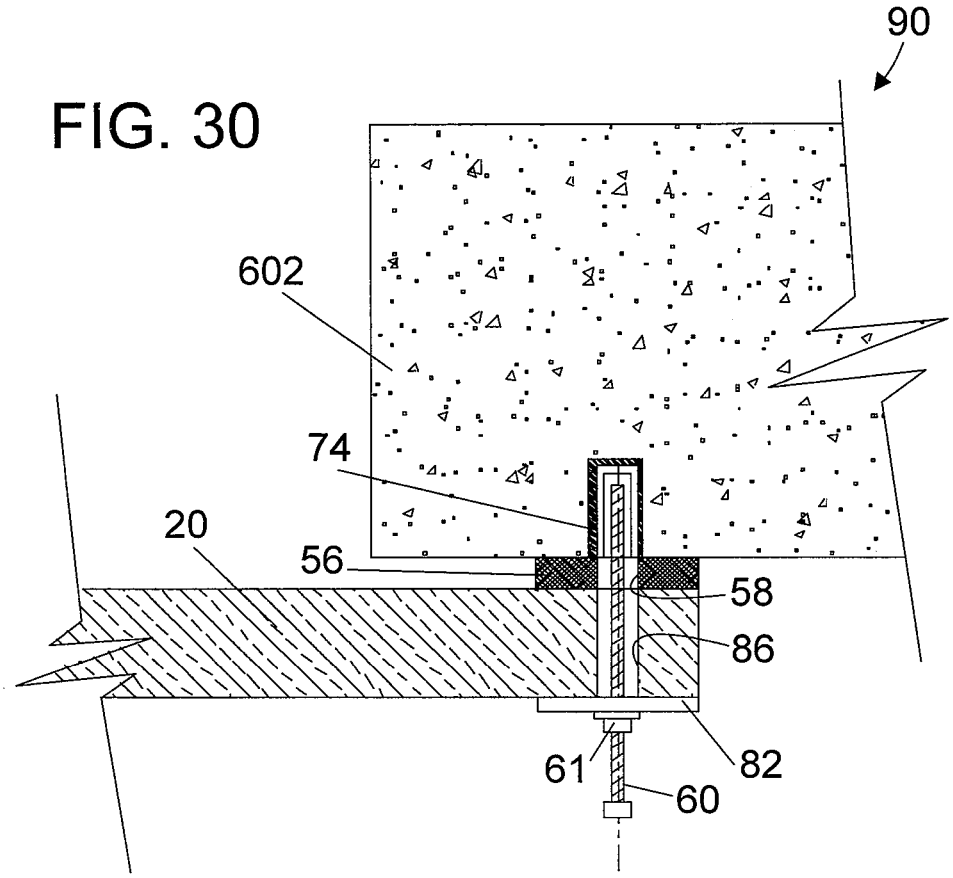
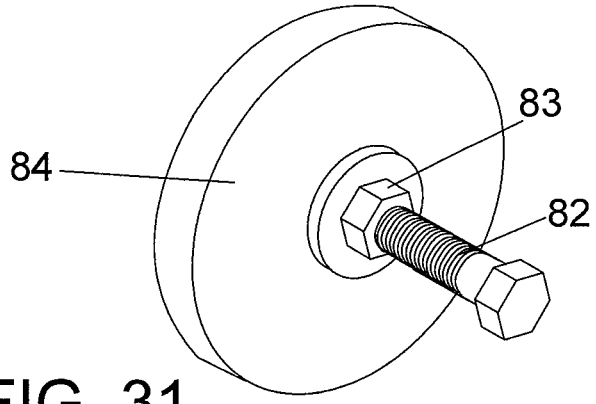
FIG. 31

APPARATUS AND SYSTEM FOR PROTECTING THE INTERIOR OF A STRUCTURE FROM FLOOD WATER

CROSS REFERENCE TO RELATED APPLICATION

This application claims the filing benefit under 35 U.S.C. § 119(e) of U.S. Provisional Application No. 62/752,438, filed Oct. 30, 2018, which is hereby incorporated by reference. This application also claims the filing benefit under 35 U.S.C. § 119(e) of U.S. Provisional Application No. 62/859,124 filed Jun. 9, 2019, which is hereby incorporated by reference.

TECHNICAL FIELD

The present invention pertains generally to flood damage protection for structures, and more particularly to an apparatus and system in which panels are mounted over the doors, windows, or other openings of a structure to prevent flood water from entering the interior of the structure.

BACKGROUND OF THE INVENTION

Flood damage is a common problem in low-lying areas. Flood waters can enter a structure such as a home or commercial building through leaks in closed doors and windows and cause considerable damage. One current way to prevent the water from entering a structure is to install barrier sheets made from aluminum or stainless steel.

BRIEF SUMMARY OF THE INVENTION

The present invention is directed to an apparatus and system for protecting the interior of structures from flood water. The apparatus and system include panels which are mounted over an opening (such as a window or a door) in the structure to block the entry of the flood water. The panels have a unique structural foam core with excellent mechanical properties and low weight. The foam core is covered by a reinforcing skin to form a composite sandwich. The resultant panel provides strength against static water loads, dynamic water loads, is fatigue resistant, and impact load resistant. Other features of the panel include excellent adhesion/peel strength, excellent chemical resistance, corrosion resistance, low water absorption and good thermal/acoustic insulation. Because of their high strength and low weight, the panels span further than metal panels without the need for additional structural support columns/posts. There is also no need for addition structural "kickers" for bracing the panels; kickers form an obstruction into public right-of-ways and a hazard to the general public.

In accordance with an embodiment, apparatus for protecting the interior of a structure having an opening from flood water includes a panel which is shaped and dimensioned to cover the opening in the structure. The panel includes a center layer which is fabricated from foam. The center layer has a first side, and an opposite second side. A first skin is connected to the first side of the center layer, and a second skin is connected to the second side of the center layer.

In accordance with another embodiment, the center layer has four edges. A layer of coating covers the first skin, the second skin, and the four edges.

In accordance with another embodiment, the center layer has a central section, the central section is fabricated from a first foam having a first density. The center layer also has a peripheral section. The peripheral section is fabricated from a second foam having a second density, the second density being greater than the first density.

In accordance with another embodiment, the panel includes a mounting bracket.

In accordance with another embodiment, the panel has one of (1) a trapezoidal shape, and (2) a horizontal top edge and a non-horizontal bottom edge.

In accordance with another embodiment, the panel is curved.

In accordance with another embodiment, the panel has a first section and an intersecting second section. The first section and the second section forming an angle.

In accordance with another embodiment, the panel includes a mounting bracket. A second panel includes a second mounting bracket. The mounting bracket is connected to the second mounting bracket with a gasket disposed therebetween.

In accordance with another embodiment, the panel has an edge. A groove is disposed along the edge.

In accordance with another embodiment, a spacer panel has an inward edge. The inward edge of the spacer panel is shaped and dimensioned to be received by the groove of the edge of the panel.

In accordance with another embodiment, the panel has a width. The spacer panel has a second width which is less than the width.

In accordance with another embodiment, the foam of the panel has a density. The spacer panel includes a foam which has a second density which is greater than the density.

In accordance with another embodiment, the spacer panel is connected to the panel, wherein the inward edge of the spacer panel is received by the groove of the edge of the panel. The spacer panel has a outward edge. A second panel has second edge with a second groove. The outward edge of the spacer panel is eived by the second groove of the second edge of the second panel.

In accordance with another embodiment, a buttress supports the panel. The panel has an inward side which includes a vertical groove which is shaped and dimensioned to receive the buttress.

Other embodiments, in addition to the embodiments enumerated above, will become apparent from the following detailed description, taken in conjunction with the accompanying drawings, which illustrate, by way of example, the principles of the apparatus and system for protecting the interior of a structure from flood water.

BRIEF DESCRIPTION OF THE DRAWINGS

FIG. 11 is a front elevation view of a panel which has a horizontal top edge and a non-horizontal bottom edge;

FIG. 12 is a front elevation view of a panel which has a trapezoidal shape;

FIG. 13 is a perspective view of a curved panel;

FIG. 14 is a perspective view of an angled panel;

FIG. 15 is a perspective view of two connected panels;

FIG. 16 is an enlarged cross sectional view along the line 16-16 of FIG. 15;

FIG. 17 is an exploded perspective view of a panel and a spacer panel;

FIG. 18 is a perspective view of the spacer panel connected to the panel;

FIG. 19 is a perspective view of a second panel with a connected spacer panel;

FIG. 20 is a reduced exploded perspective view of multiple panels;

FIG. 21 is a reduced perspective view of the multiple panels connected to form a span;

FIG. 22 is a reduced top plan view of the multiple connected panels of FIG. 21;

FIG. 23 is an enlarged cross sectional view along the line 23-23 of FIG. 17;

FIG. 24 is an enlarged cross sectional view along the line 24-24 of FIG. 20;

FIG. 25 is an enlarged cross sectional view along the line 25-25 of FIG. 21;

FIG. 30 is an enlarged cross sectional view along the line 30-30 of FIG. 28.

FIG. 31 is an enlarged view of area 31 of FIG. 28;

DETAILED DESCRIPTION OF THE INVENTION

Figure 1:
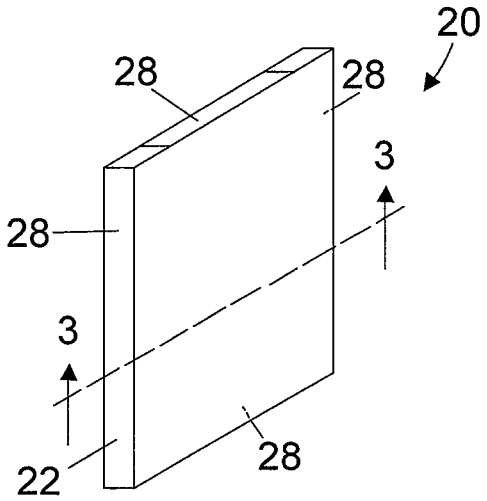
FIG. 1 is a perspective view of a panel for protecting the interior of a structure from flood water.
Figure 2:
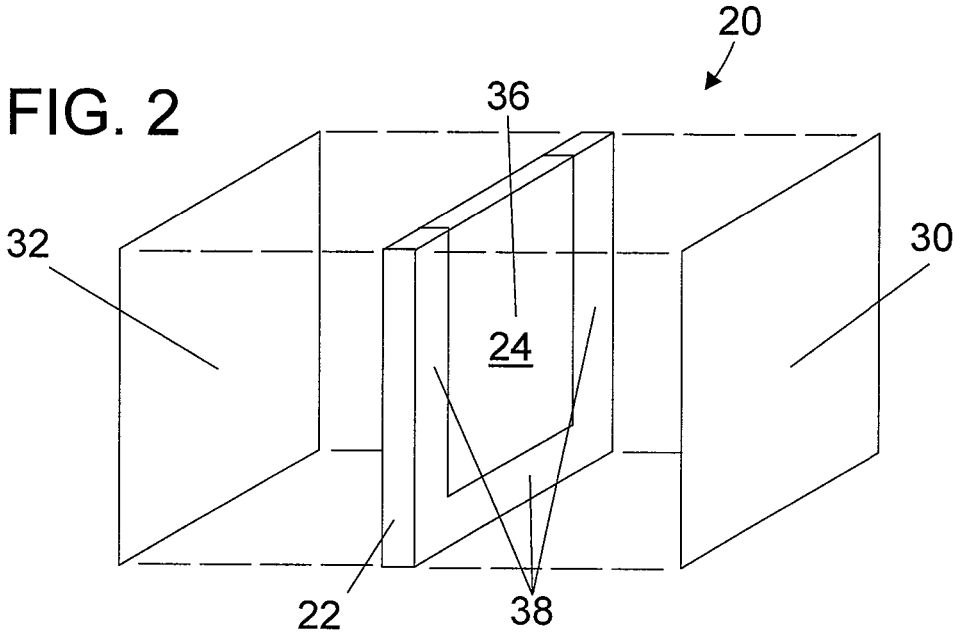
FIG. 2 is an exploded perspective view of the panel.
Figure 3:
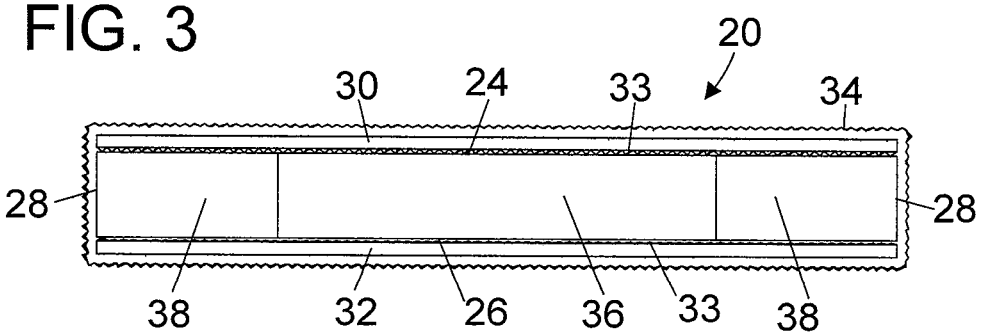
FIG. 3 is an enlarged cross section view along the line 3-3 of FIG. 1.

FIG. 1 is a perspective view of a panel 20 of an apparatus and system for protecting the interior of a structure 500 from flood water, FIG. 2 is a an exploded perspective of panel 20, and FIG. 3 is a cross sectional view along the line 3-3 of FIG. 1. Panel 20 is shaped and dimension to cover an opening 502 in the structure 500 such as a window, a door, a vent, or any other opening through which water could pass (also refer to FIG. 4). Panel 20 includes a center layer 22 which is fabricated from foam.

As used herein the term foam includes a rigid foam which has a high strength-to-weight ratio. Other properties of the foam can include, moisture resistance, solvent resistance, and laminate and adhesive compatibility. In one embodiment, the foam can be a closed cell elastomer (e.g. a PVC foam), and in particular can be an interpenetrating polymer network (IPN) elastomer. The density of the foam can vary depending upon the application, with densities of 80 $Kg/M^3$ and 130 $Kg/M^3$ having been found useful.

Center layer 22 (core) has a first side 24, an opposite second side 26, and four edges 28. A first skin 30 is connected to first side 24 of center layer 22. A second skin 32 is connected to second side 26 of center layer 22. In an embodiment, first skin 30 and second skin 32 are reinforced glass fiber (e.g. 3 mm thick) and are connected to center layer 22 a with polyurethane adhesive 33. A layer of coating 34 covers first skin 30, second skin 32, and four edges 28 so that panel 20 is sealed. In an embodiment, the coating is polyurea and has a thickness of between about 1/32 inches and 5/64 inches depending upon specific job requirements. It is noted that in FIG. 3, the various layers of panel 20 have not been shown to scale for better clarity.

Center layer 22 has a central section 36 which is fabricated from a first foam having a first density (e.g. 80 $Kg/M^3$). And, center layer 22 has a peripheral section 38 which is fabricated from a second foam having a second density (e.g. 130 $Kg/M^3$), wherein the second density is greater than the first density. The higher density of the peripheral section 38 provides greater compression at locations where panel 20 is attached to a structure (refer to FIG. 4). In the shown embodiment the peripheral section 38 includes two sides and the bottom of the panel 20. In another embodiment, peripheral section 38 includes two side, the bottom, and the top of the panel 20 (refer to FIGS. 8-10). Center layer, including central section 36 and peripheral section 38 can be made in various thicknesses (such as 3, inches, four inches, etc.) depending upon the particular application. It is also noted that in the shown embodiment panel 20 is non-metallic.

Figure 4:
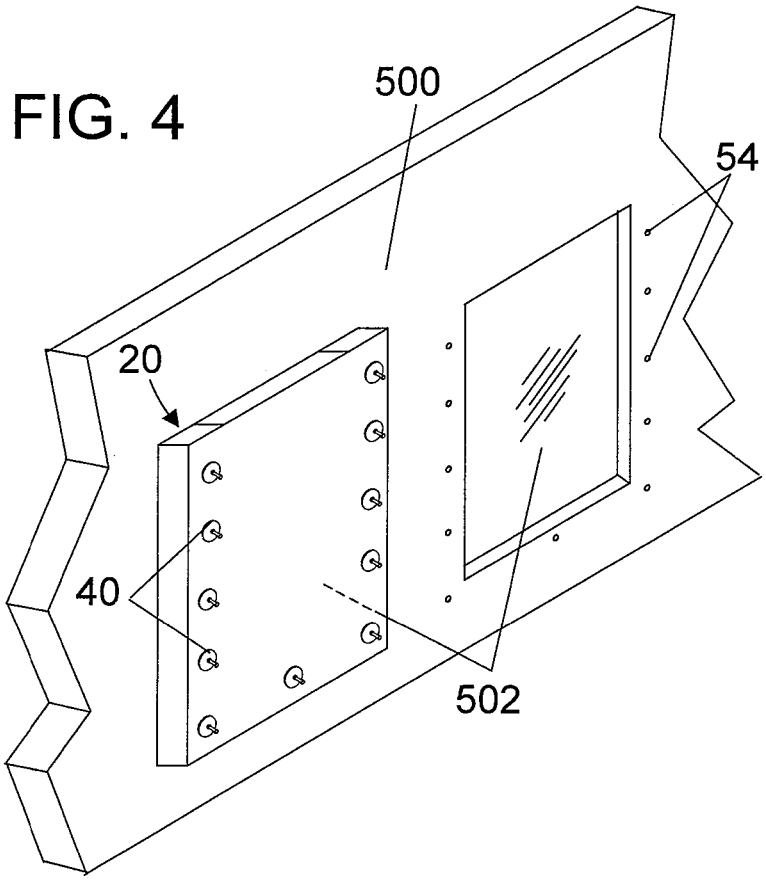
FIG. 4 is perspective view of the panel covering an opening of a structure.

FIG. 4 is a perspective view of panel 20 covering an opening 502 (a window) of structure 500 (a building). Fasteners 40 hold panel 20 over the opening 502, and in the shown embodiment are placed along the sides and bottom of the panel. Panel 20 provides structural resistance to both the hydrostatic and hydrodynamic pressure of flood waters and intermittent impact forces from floating debris. It is noted that one window 502 has not yet been covered, but that anchors 74 have been installed to receive the fasteners 40 (refer also to FIGS. 29-30).

Figure 5:
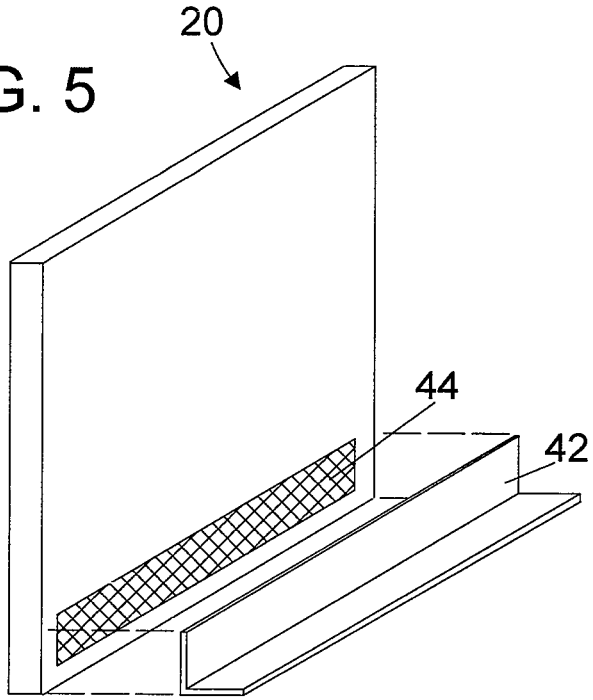
FIG. 5 is a exploded perspective view of a panel with an attached mounting bracket.
Figure 7:
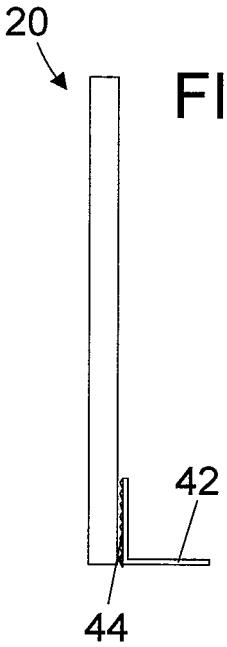
FIG. 7 is a side elevation view of the panel with the mounting bracket.
Figure 6:
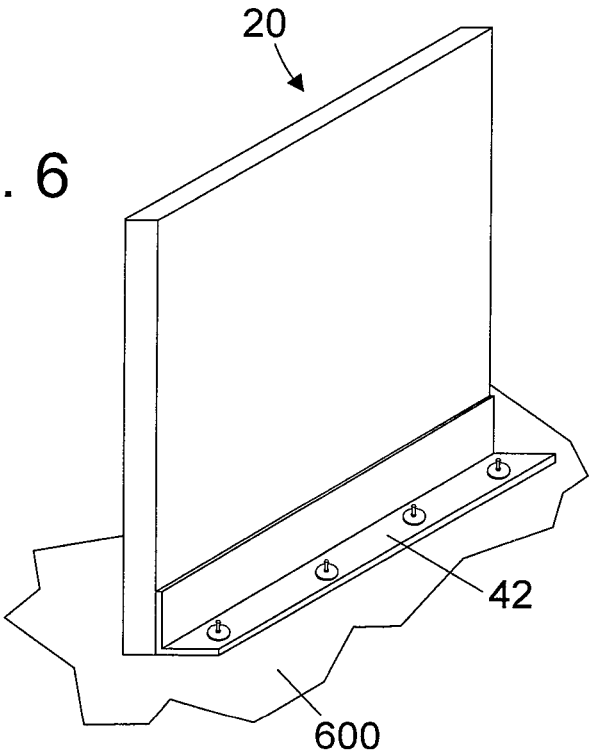
FIG. 6 is a perspective view of the panel with the mounting bracket.

FIGS. 5-7 are exploded perspective, perspective, and side elevation views respectively of a panel 20 which includes a mounting bracket 42. The mounting bracket 42 is utilized to anchor panel 20 to a horizontal support surface 600 such as a floor when wall anchoring is not possible. In the shown embodiment mounting bracket 42 is a structural angle made from fiberglass, and is 4"×4"×0.25". Mounting bracket 42 is attached to panel 20 with methacrylate adhesive 44.

Figure 8:
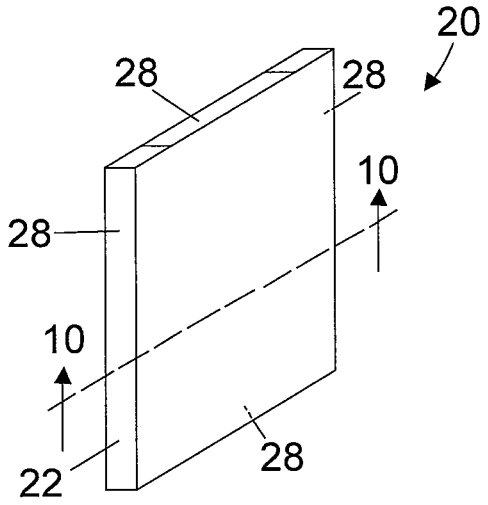
FIG. 8 is a perspective view of another panel for protecting the interior of a structure from flood water.
Figure 9:
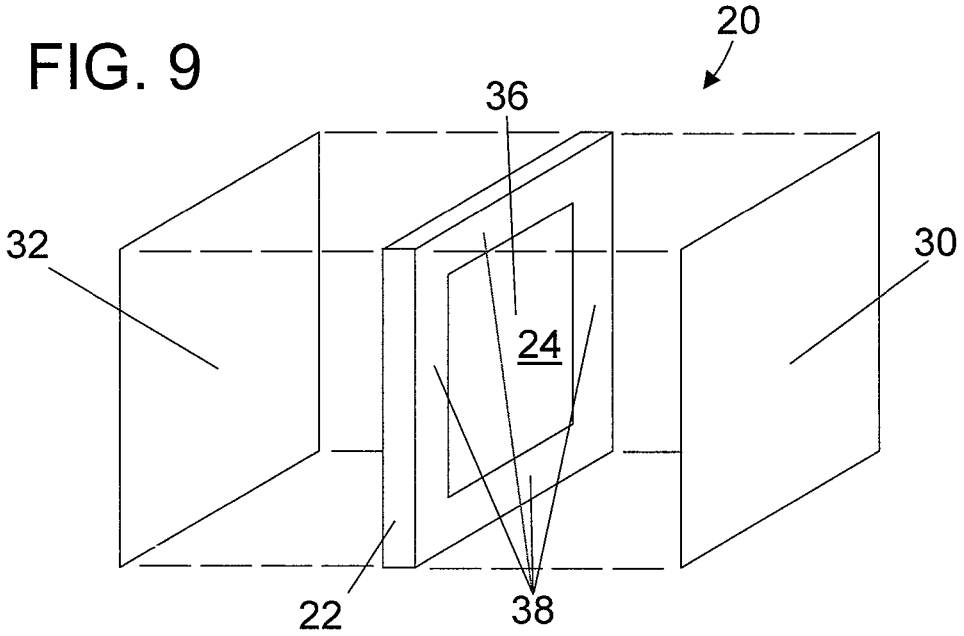
FIG. 9 is an exploded perspective view of the panel of FIG. 8.
Figure 10:
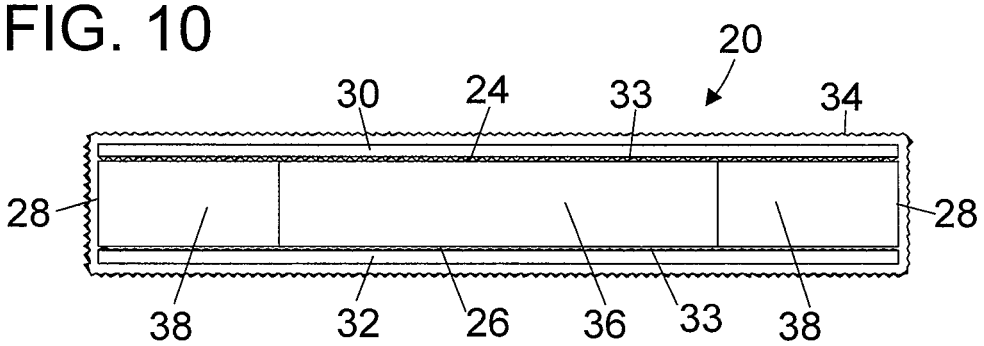
FIG. 10 is an enlarged cross section view along the line 10-10 of FIG. 8.

FIG. 8 is a perspective view of another panel 20 of a system for protecting a structure 500 from flood water, FIG. 9 is a an exploded perspective of panel 20, and FIG. 10 is an enlarged cross sectional view along the line 10-10 of FIG. 8. This panel 20 is the same as that of FIGS. 1-3 except that peripheral section 38 includes the two sides, the bottom, and the top. As such, fasteners 40 (refer to FIG. 4) can be placed all around the pane 20.

FIG. 11 is a front elevation view of a panel 20 which has a horizontal top edge 46 and a non-horizontal bottom edge 48 and two parallel side edges (i.e. the top and bottom edges are not parallel. Such a panel 20 can be utilized to accommodate sloped grades and decorative angled window styles.

FIG. 12 is a front elevation view of a panel 20 which has a trapezoidal shape. It may be appreciated that panel 20 can be customized to virtually any desired shape to accommodate installation requirements.

FIG. 13 is a perspective view of a curved panel 20. That is, panel 20 has a radius in the plane of the face of the panel (20) to accommodate structures which have rounded features.

FIG. 14 is a perspective view of a panel 20 which has an angle. Panel has a first section 20-A and an intersecting second section 20-B. First section 20-A and second section 20-B form an angle A. In the shown embodiment angle A is 90°, however it may be appreciated that other angles are also possible to match structure requirements. Angled panel 20 is useful for surrounding the corners or other angled areas of structures.

FIG. 15 is a perspective view of two connected panels 20*a* and 20*b*, and FIG. 16 is an enlarged cross sectional view along the line 16-16 of FIG. 15. Panel 20*a* includes a mounting bracket 42*a*, and second panel 20*b* includes a second mounting bracket 42*b*. Mounting bracket 42*a* connected to second mounting bracket 42*b* with a gasket 56 disposed therebetween. A bolt, nut, and washers are utilized to effect the connection, and when tightened compress gasket 56 to form a water tight seal. Such a stacked panel configuration is useful to allow flood protection for high window and door openings. In the shown embodiment second panel 20*b* is connected to a horizontal support surface 600.

FIGS. 17-25 depict embodiments of the apparatus in which multiple panels are connected to create a span (a wall) which covers a lengthy opening in a structure. To that end, FIG. 17 is an exploded perspective view of a panel 20 and a spacer panel 60, and FIG. 18 is a perspective view of the spacer panel 60 connected to the panel 20 to form a combination panel 20A. Panel 20 has an edge 62. A groove 64 is disposed along edge 62. Spacer panel 60 has an inward edge 66 which is shaped and dimensioned to be received by groove 64 of edge 62 of panel 20. In FIG. 18, the inward edge 66 of spacer panel 60 is inserted into groove 64 and fastened in place with an adhesive (such as polyurethane). The combined panel 20 and spacer panel 60 are designated as panel 20A. In an embodiment, panel 20 is fabricated from a foam which has a density. It is noted that if panel 20 is fabricated from two different density foams (refer to the FIGS. 2 and 9 and the associated descriptions) the density of the foam of panel 20 will be an average density which lies somewhere between the two foam densities. Spacer panel 60 includes single foam which has a second density, wherein the second density is greater than the density (average density) of the foam of panel 20.

FIG. 19 is a perspective view of a second panel 20 with a connected spacer panel 60, the combination designated as panel 20B. This configuration is similar to that of panel 20A, except that panel 20B also has a groove 68 disposed on the opposite edge 67.

FIG. 20 is a reduced exploded perspective view of multiple panels, FIG. 21 is a reduced perspective view of the multiple panels connected to form a span, and FIG. 22 is a reduced top plan view of the multiple connected panels of FIG. 21. In the shown embodiment, four panels (20A, 20B, 20B, and 20C are connected to span a distance. That is, panel 20C has a groove 70 on the opposite side from groove 64 of panel 20A (refer to FIG. 17). In FIG. 21 the four panels (20A, 20B, 20B, and 20C) are connected together, and are also connected to a horizontal surface 600 of a structure (e.g. a floor) and to a vertical surface 602 of a structure (such as a wall). It is noted that panel 20C has a groove 71 of the opposite edge from panel 20A. Panels 20A and 20C are the opposite end panels of the span. Referring also to FIGS. 18-19, spacer panel 60 is connected to panel 20, wherein inward edge 66 of spacer panel 60 is received by groove 64 of edge 62 of panel 20 (to form combined panel 20A). Spacer panel 60 has an outward edge 70. A second panel 20B has a second edge 71 with a second groove 68. The outward edge 70 of spacer 60 of panel 20A is received by second groove 68 of second edge 71 of second panel 20B. Using this tongue and groove connection methodology, it may be appreciated that other numbers of side-by-side panels can be connected to span an opening (e.g. 2, 3, 5, 6, etc.). In the shown embodiment, the length of the span can be adjusted by adding more or less panels 20B. In FIG. 21 the flood water side and the protected interior are indicated.

FIG. 23 is an enlarged cross sectional view along the line 23-23 of FIG. 17. It is noted that panel 20 has a width W, and that spacer 60 has a width W1 which is less than width W. Also shown are groove 64 of edge 62 of panel 20, and inward edge 66 of spacer 60.

FIG. 24 is an enlarged cross sectional view along the line 24-24 of FIG. 20. This view shows the connection of panel 20A to panel 20B, where outer edge 70 of spacer panel 60 of panel 20A is received by groove 68 of panel 20B.

FIG. 25 is an enlarged cross sectional view along the line 25-25 of FIG. 21, showing panel 20A connected to panel 20B. The connection is effected by connection hardware such as a bolt, a nut, a gasket, and washers. It is noted that multiple vertical connections of the two panels are made to provide the necessary strength (refer to FIG. 21).

Figure 26:
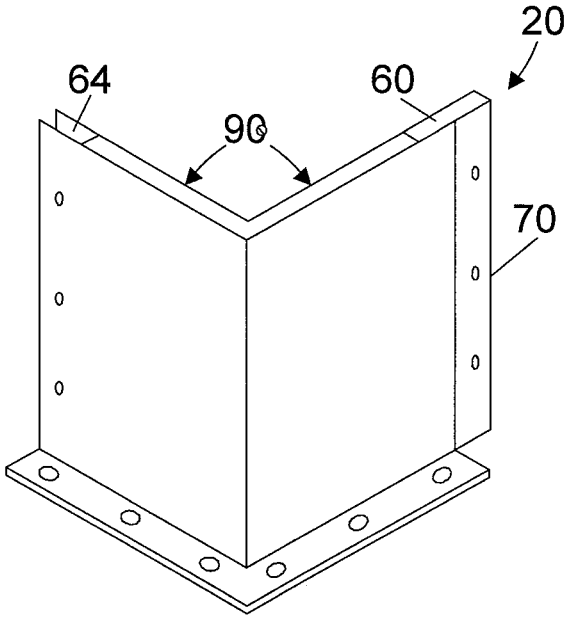
FIG. 26 is a perspective view of a corner panel.

FIG. 26 is a perspective view of a corner panel 20. In the shown embodiment corner panel 20 forms a 90° angle. One edge of corner panel 20 has groove 64, and the other edge of corner panel 20 has a spacer panel 60 with an outward edge 70.

Figure 27:
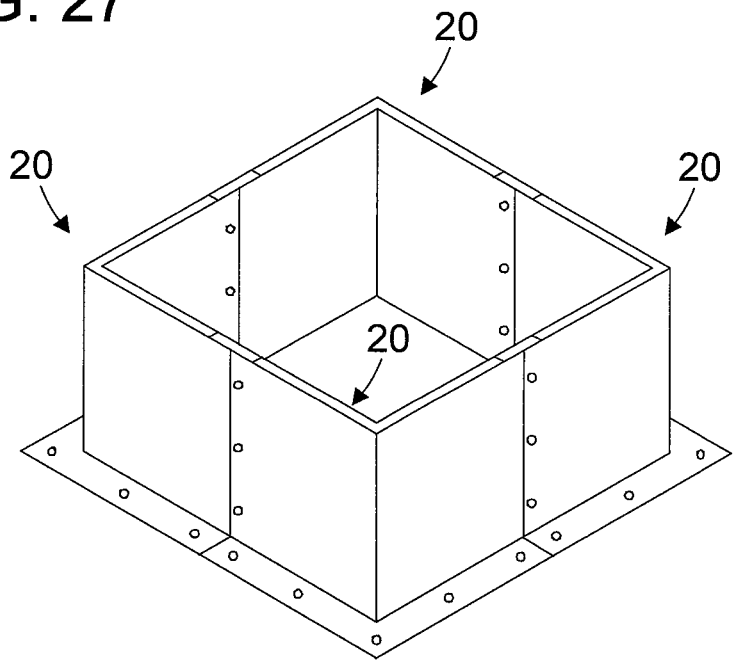
FIG. 27 is a perspective view of four corner panels connected to form a square.

FIG. 27 is a perspective view of four corner panels 20 connected to form a square.

Figure 28:
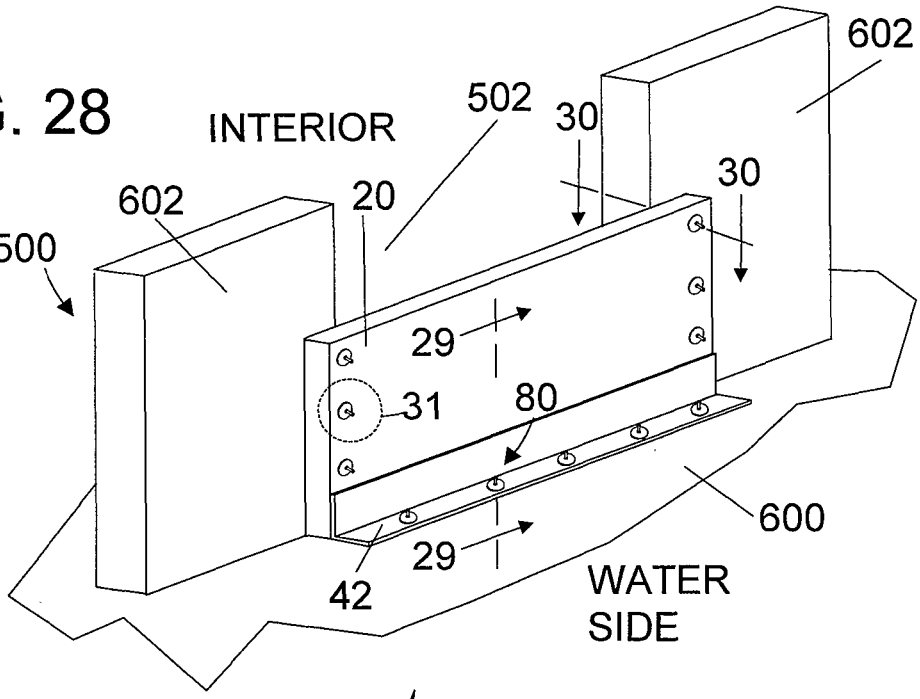
FIG. 28 is a perspective view of a panel fastened to the floor and to the wall of a structure.
Figure 29:
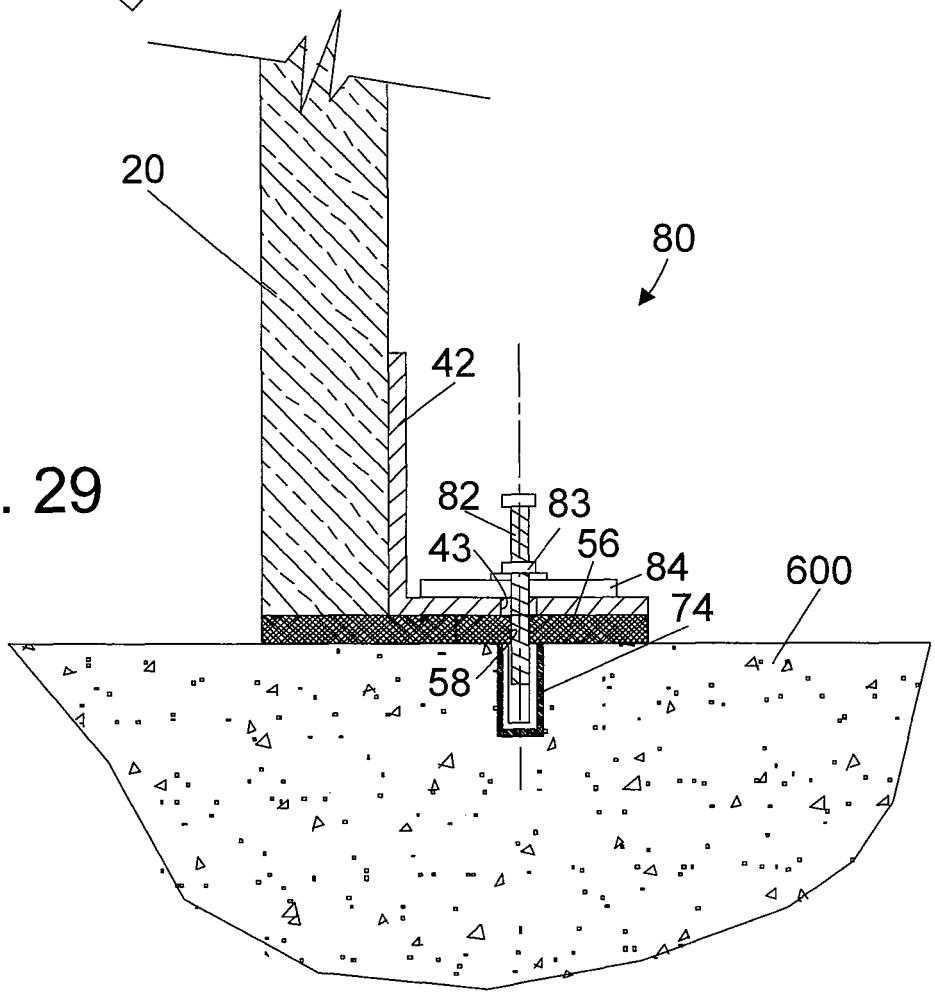
FIG. 29 is an enlarged cross sectional view along the line 29-29 of FIG. 28.

It may be appreciated that panel 20 may be combined with structure 500 having a horizontal surface 600 and a vertical surface 602 to form a system for protecting from flood water. In that regard, FIG. 28 is a perspective view of a panel 20 which is fastened to both the floor and to the wall of a structure, in which panel 20 is both directly and indirectly fastened to the structure. FIG. 29 is an enlarged cross sectional view along the line 29-29 of FIG. 28, and FIG. 30 is an enlarged cross sectional view along the line 30-30 of FIG. 28. In the shown example, panel 20 is fastened to both a horizontal surface 600 (e.g. a concrete floor) and to a vertical surface 602 (e.g. a concrete wall) of the structure 500 to cover opening 502 (such as a driveway into a structure). Referring to FIG. 29, an indirect fastening system 80 which fastens panel 20 to the horizontal surface 600 includes the panel 20 having a mounting bracket 42 which has a hole 43. An anchor 74 having a threaded insert is embedded in the horizontal surface 600. A gasket 56 (such as one made of (neoprene) has a hole 58. Gasket 56 is disposed (1) between panel 20 and the horizontal surface 600, and (2) between mounting bracket 42 and the horizontal surface 600. A bolt 82 having a nut 83 passes through a washer 84, through hole 43 in mounting bracket 42, through hole 58 in gasket 56 and engages the threaded insert of anchor 74. When bolt 82/nut 83 is tightened, gasket 56 is compressed to ensure a watertight seal between both (1) panel 20 and horizontal surface 600, and (2) mounting bracket 42 and horizontal surface 600. It may be appreciated that indirect fastening system 80 could also be utilized to fasten panel 20 to a vertical surface 602 such as a wall. In FIG. 28 the flood water side and the protected interior are indicated.

Referring to FIG. 30, a direct fastening system 90 which fastens panel 20 to the vertical surface 602 includes the panel 20 having a hole 86. An anchor 74 having a threaded insert is embedded in the vertical surface 600. A gasket 56 (such as one made of (neoprene) has a hole 58. Gasket 56 is disposed between panel 20 and the vertical surface 602. A bolt 82 having a nut 83 passes through a washer 84, through hole 86 in panel 20, through hole 58 in gasket 56 and engages the threaded insert of anchor 74. When bolt 82/nut 83 is tightened, gasket 56 is compressed to ensure a water-tight seal between panel 20 and vertical surface 602.

FIG. 31 is an enlarged view of area 18 of FIG. 15, showing bolt 82, nut 83, and washer 84.

Figure 32:
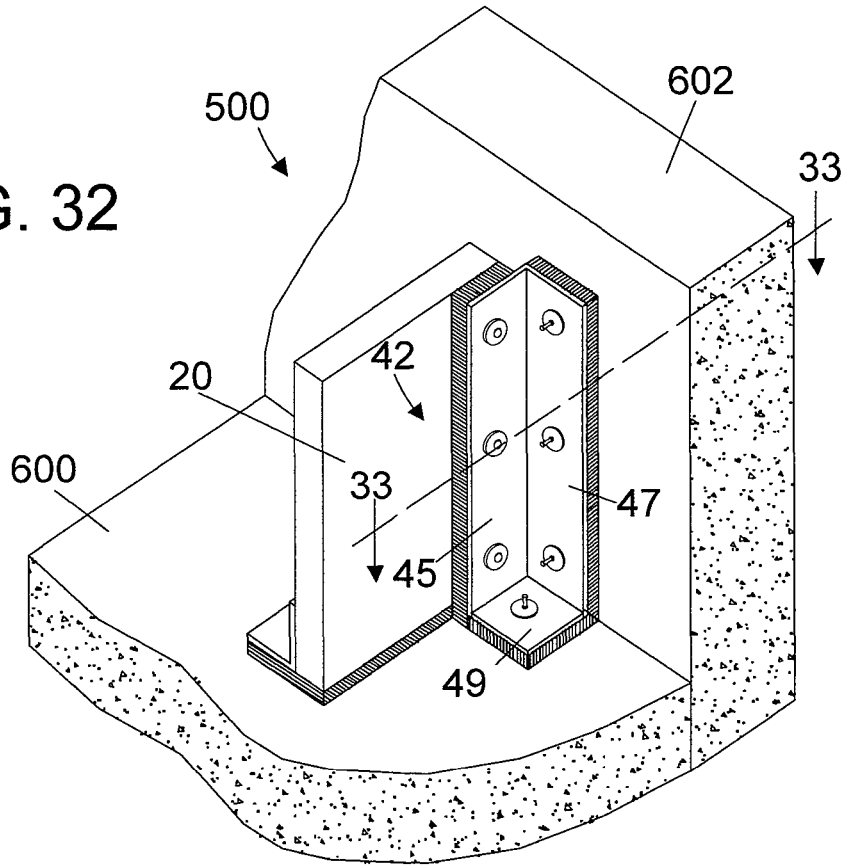
FIG. 32 is a perspective view of a panel connected to both the horizontal and vertical surfaces of a structure.
Figure 33:
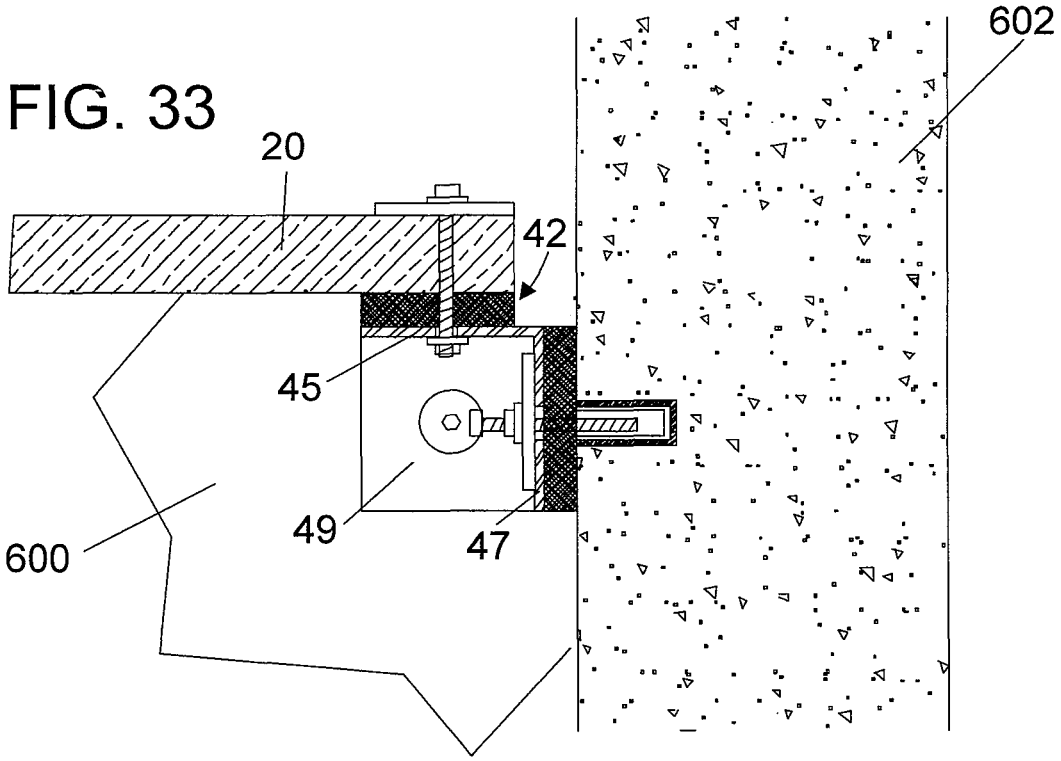
FIG. 33 is an enlarged cross sectional view along the line 33-33 of FIG. 32.

FIG. 32 is a perspective view of a panel 20 connected to both the horizontal 600 and vertical 602 surfaces of a structure 500, and FIG. 33 is an enlarged cross sectional view along the line 33-33 of FIG. 32. A mounting bracket 42 has a first side 45 and a second side 47 with an angle therebetween, First side 45 is connected to panel 20, and second side 47 is connected to vertical surface 602 of structure 600. An end cap 49 is perpendicularly connected to first side 45 and second side 47 of bracket 42. End cap 49 is connected to horizontal surface 600 of structure 500. This configuration is useful when panel 20 cannot be directly connected to a vertical surface 602.

Figure 34:
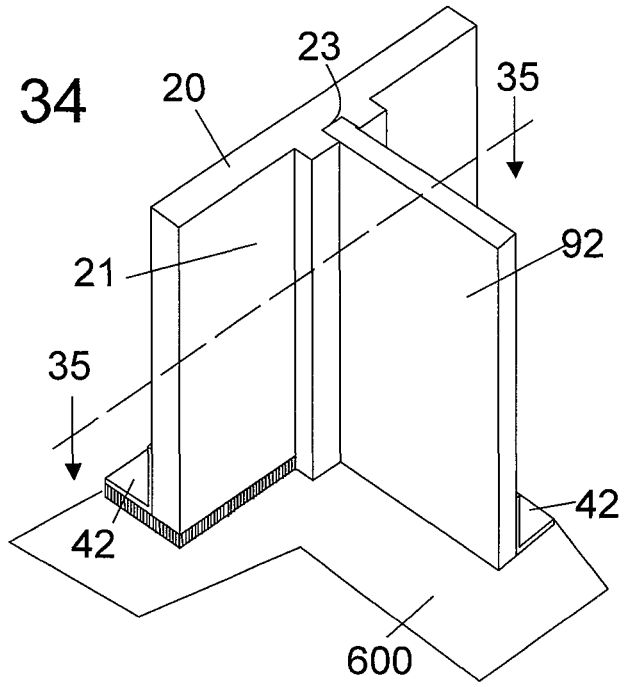
FIG. 34 is a perspective view of a buttress connected to a panel.
Figure 35:
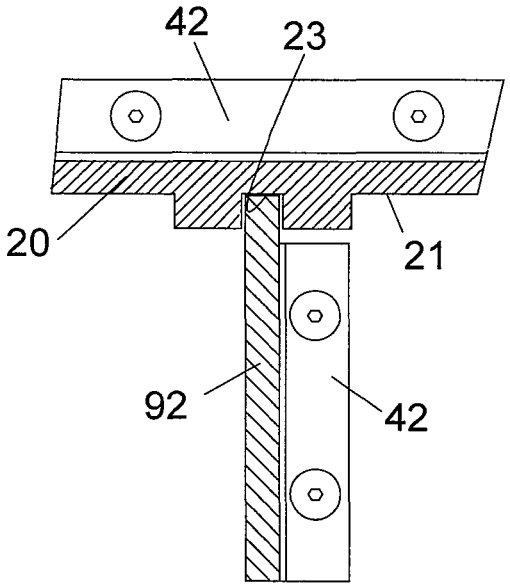
FIG. 35 is an enlarged cross sectional view along the line 35-35 of FIG. 34.

FIG. 34 is a perspective view of a buttress 92 connected to a panel 20, and FIG. 35 is an enlarged cross sectional view along the line 35-35 of FIG. 34. Buttress 90 is utilized when an opening is very large and a single panel or multiple connected panels are insufficient to handle water loads. Buttress 92 provides a perpendicular support (brace) which accommodates higher water loading. The structure includes a horizontal surface 600. Buttress 92 is connected to horizontal surface 600 in the pre-described manner. Panel 20 has an inward side 21 (the interior side). Inward side 21 includes a vertical groove which receives buttress 92. in an embodiment, the height of buttress 90 is equal to that of panel 20. A typical location for buttress 92 is shown in dashed lines of FIGS. 21 and 22.

The embodiments of the apparatus and system for protecting a structure from flood water described herein are exemplary and numerous modifications, combinations, variations, and rearrangements can be readily envisioned to achieve an equivalent result, all of which are intended to be embraced within the scope of the appended claims. Further, nothing in the above-provided discussions of the apparatus and system for protecting a structure from flood water should be construed as limiting the invention to a particular embodiment or combination of embodiments. The scope of the invention is defined by the appended claims.

I claim:

1. Apparatus for protecting an interior of a structure from flood water, the structure having an opening, the apparatus comprising:

a panel which is shaped and dimensioned to cover the opening in the structure, said panel including;

a center layer fabricated from foam, said center layer having a first side, and an opposite second side;

a first skin connected to said first side of said center layer;

a second skin connected to said second side of said center layer;

said center layer having a central section, said central section fabricated from a first foam having a first density; and, said center layer having a peripheral section, said peripheral section fabricated from a second foam having a second density, said second density being greater than said first density.

2. The apparatus according to claim 1, further including:

said center layer having four edges; and, a layer of coating covering said first skin, said second skin, and said four edges.

3. The apparatus according to claim 1, further including:

said panel including a mounting bracket.

4. The apparatus according to claim 1, further including:

said panel having one of (1) a trapezoidal shape, and (2) a horizontal top edge and a non-horizontal bottom edge.

5. The apparatus according to claim 1, further including:

said panel being curved.

6. The apparatus according to claim 1, further including:

said panel having a first section and an intersecting second section; and, said first section and said second section forming an angle.

7. The apparatus according to claim 1, further including:

said panel including a mounting bracket;

a second panel including a second mounting bracket;

a gasket; and, said mounting bracket connected to said second mounting bracket with said gasket disposed therebetween.

8. The apparatus according to claim 1, further including:

a buttress;

said panel having an inward side; and, said inward side including a vertical groove which is shaped and dimensioned to receive said buttress.

9. Apparatus for protecting an interior of a structure from flood water, the structure having an opening, the apparatus comprising:

a panel which is shaped and dimensioned to cover the opening in the structure, said panel including;

a center layer fabricated from foam, said center layer having a first side, and an opposite second side;

a first skin connected to said first side of said center layer;

a second skin connected to said second side of said center layer;

said panel having an edge;

a groove disposed along said edge;

said foam of said panel having a density;

a spacer panel having an inward edge;

said inward edge of said spacer panel shaped and dimensioned to be received by said groove of said edge of said panel;

said spacer panel including a foam which has a second density which is greater than said density.

10. The apparatus according to claim 9, further including:

said spacer panel connected to said panel, wherein said inward edge of said spacer panel is received by said groove of said edge of said panel;

said spacer panel having an outward edge;

a second panel having a second edge with a second groove; and, said outward edge of said spacer panel received by said second groove of said second edge of said second panel.

11. Apparatus for protecting an interior of a structure from flood water, the structure having an opening, the apparatus comprising:

a panel which is shaped and dimensioned to cover the opening in the structure, said panel including;

a center layer fabricated from foam, said center layer having a first side, and an opposite second side;

a first skin connected to said first side of said center layer;

a second skin connected to said second side of said center layer;

said center layer having four edges;

a layer of coating covering said first skin, said second skin, and said four edges;

said center layer having a central section, said central section fabricated from a first foam having a first density; and, said center layer having a peripheral section, said peripheral section fabricated from a second foam having a second density, said second density being greater than said first density.

12. Apparatus for protecting an interior of a structure from flood water, the structure having an opening, the apparatus comprising:

a panel which is shaped and dimensioned to cover the opening in the structure, said panel including:

a center layer fabricated from foam, said center layer having a first side, and an opposite second side;

a first skin connected to said first side of said center layer;

a second skin connected to said second side of said center layer;

said panel including a mounting bracket;

said panel having an edge;

a groove disposed along said edge;

said panel having a width;

said foam of said panel having a density;

a spacer panel having an inward edge;

said inward edge of said spacer panel shaped and dimensioned to be received by said groove of said edge of said panel;

said spacer panel having a second width which is less than said width;

said spacer panel including a foam which has a second density which is greater than said density;

said spacer panel connected to said panel, wherein said inward edge of said spacer panel is received by said groove of said edge of said panel;

said spacer panel having a outward edge;

a second panel having a second edge with a second groove; and, said outward edge of said spacer panel received by said second groove of said second edge of said second panel.

13. A system for protecting from flood water, comprising:

a structure having an opening;

said structure including a horizontal surface;

a panel which is shaped and dimensioned to cover said opening in said structure, said panel including;

a center layer fabricated from foam, said center layer having a first side, and an opposite second side;

a first skin connected to said first side of said center layer; and, a second skin connected to said second side of said center layer;

said panel including a mounting bracket having a hole;

an indirect fastening system which fastens said panel to said horizontal surface, said indirect fastening system including:

an anchor which is embedded in said horizontal surface, said anchor having a threaded insert;

a gasket having a hole, said gasket disposed (1) between said panel and said horizontal surface, and (2) between said mounting bracket and said horizontal surface;

a washer; and, a bolt having a nut, said bolt passes through said washer, said hole in said mounting bracket, said hole in said gasket, and engages said threaded insert of said anchor.

14. A system for protecting from flood water, comprising:

a structure having an opening:

said structure including a vertical surface;

a panel which is shaped and dimensioned to cover said opening in said structure, said panel including;

a center layer fabricated from foam, said center layer having a first side, and an opposite second side;

a first skin connected to said first side of said center layer;

a second skin connected to said second side of said center layer;

said panel having a hole;

a direct fastening system which fastens said panel to said vertical surface, said direct fastening system including:

an anchor which is embedded in said vertical surface, said anchor having a threaded insert;

a gasket having a hole, said gasket disposed between said panel and said vertical surface;

a washer; and, a bolt having a nut, said bolt passes through said washer, said hole in said panel, said hole in said gasket, and engages said threaded insert of said anchor.

15. A system for protecting from flood water, comprising:

a structure having an opening:

said structure including a horizontal surface;

a buttress which is connected to said horizontal surface;

a panel which is shaped and dimensioned to cover said opening in said structure, said panel including;

a center layer fabricated from foam, said center layer having a first side, and an opposite second side;

a first skin connected to said first side of said center layer; and, a second skin connected to said second side of said center layer;

said panel including a mounting bracket having a hole;

said panel having an inward side; and, said inward side including a vertical groove which receives said buttress.

* * * * *